US012232561B2

(12) United States Patent
Hatfield et al.

(10) Patent No.: US 12,232,561 B2
(45) Date of Patent: Feb. 25, 2025

(54) ARTICLES OF FOOTWEAR AND UPPER AND/OR SOLE COMPONENTS THEREFOR

(71) Applicant: NIKE, Inc., Beaverton, OR (US)

(72) Inventors: Tobie D. Hatfield, Lake Oswego, OR (US); Katelyn Ricciardi, Hillsboro, OR (US); George A. Xanthos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 31 days.

(21) Appl. No.: 18/169,507

(22) Filed: Feb. 15, 2023

(65) Prior Publication Data

US 2023/0292881 A1 Sep. 21, 2023

Related U.S. Application Data

(60) Provisional application No. 63/320,942, filed on Mar. 17, 2022.

(51) Int. Cl.

| | |
|---|---|
| ***A43B 13/22*** | (2006.01) |
| ***A43B 5/00*** | (2022.01) |
| ***A43B 13/14*** | (2006.01) |

(52) U.S. Cl.

CPC ..... *A43B 13/223* (2013.01); *A43B 5/003* (2013.01); *A43B 13/146* (2013.01)

(58) Field of Classification Search

CPC ..... A43B 5/003; A43B 13/223

See application file for complete search history.

(56) References Cited

U.S. PATENT DOCUMENTS

| | | | | |
|---|---|---|---|---|
| 2,162,912 | A * | 6/1939 | Craver | A43B 13/223 D2/960 |
| 2,206,860 | A * | 7/1940 | Sperry | A43B 13/223 36/59 R |
| 4,716,663 | A * | 1/1988 | Steinhauser | A43B 5/003 36/114 |
| 6,115,945 | A * | 9/2000 | Ellis, III | A43B 13/148 36/102 |
| 2009/0113766 | A1 * | 5/2009 | Hooper | A43B 7/12 36/114 |

(Continued)

FOREIGN PATENT DOCUMENTS

WO WO-2013014433 A1 * 1/2013 ..... A43B 13/24

*Primary Examiner* — Ted Kavanaugh

(74) *Attorney, Agent, or Firm* — Banner & Witcoff, Ltd.

(57) ABSTRACT

Articles of footwear include upper components and/or sole components. In some examples, the articles of footwear and/or sole structures may include features making them well suited for obstacle course type athletic events (e.g., by providing enhanced traction for various obstacle course events, such as wall climb events, rope climb events, etc.). As some more specific examples, articles of footwear and/or components thereof may include one or more of: (a) a ground-contacting surface having a plurality of large grooves, a plurality of small grooves, and relatively flat and/or smoothly curved base surfaces between the grooves; (b) a medial sidewall having a concave exterior surface, e.g., in the midfoot area; (c) a medial sidewall having enhanced traction features, e.g., in the midfoot area; and/or (d) a medial instep component (e.g., medial eye stay reinforcing component) having enhanced traction features.

20 Claims, 8 Drawing Sheets

(56) References Cited

U.S. PATENT DOCUMENTS

| | | | | |
|---|---|---|---|---|
| 2009/0293314 | A1* | 12/2009 | Dekovic | A43B 13/186 36/103 |
| 2010/0229424 | A1* | 9/2010 | Roberti | A43B 13/26 36/103 |
| 2010/0281714 | A1* | 11/2010 | Carboy | A43B 13/14 36/25 R |
| 2010/0293815 | A1* | 11/2010 | Ferrigan | A43B 13/16 36/25 R |
| 2012/0144701 | A1* | 6/2012 | Linth | A43B 13/223 36/25 R |
| 2012/0304503 | A1* | 12/2012 | Bouvet | A43B 5/003 36/32 R |
| 2015/0342300 | A1* | 12/2015 | Cin | A43B 13/127 36/103 |
| 2017/0258179 | A1* | 9/2017 | Conant | A43B 13/141 |
| 2019/0365044 | A1* | 12/2019 | Cross | A43B 13/12 |
| 2021/0368919 | A1* | 12/2021 | Holmes | A43B 13/125 |
| 2023/0058209 | A1* | 2/2023 | Siegismund | A43B 13/181 |
| 2023/0129224 | A1* | 4/2023 | Berrian | D04B 1/12 36/45 |
| 2024/0148110 | A1* | 5/2024 | Crumbleholme | A43B 23/025 |

* cited by examiner

ARTICLES OF FOOTWEAR AND UPPER AND/OR SOLE COMPONENTS THEREFOR

RELATED APPLICATION DATA

This application is a U.S. Non-Provisional Application based on and claiming priority to U.S. Provisional Patent Appln. No. 63/320,942 filed Mar. 17, 2022 and entitled "Articles of Footwear and Upper and/or Sole Components Therefor." U.S. Provisional Patent Appln. No. 63/320,942 is entirely incorporated herein by reference.

FIELD OF THE INVENTION

Aspects of the present invention relate to articles of footwear, upper components for articles of footwear, and/or sole components for articles of footwear. At least some of the disclosed articles of footwear, upper components, and/or sole components may be well suited for obstacle course type athletic events (e.g., by providing enhanced traction for various obstacle course events).

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

SUMMARY

This Summary introduces some general concepts relating to this technology in a simplified form that are further described below in the Detailed Description. This Summary is not intended to identify key features or essential features of the invention.

Articles of footwear include upper components and/or sole components. In some examples, the articles of footwear and/or sole structures may include features making them well suited for obstacle course type athletic events (e.g., by providing enhanced traction for various obstacle course events, such as wall climb events, rope climb events, etc.). As some more specific examples, articles of footwear and/or components thereof may include one or more of: (a) a ground-contacting surface having a plurality of large grooves, a plurality of small grooves, and relatively flat and/or smoothly curved base surfaces between the grooves; (b) a medial sidewall having a concave exterior surface, e.g., in the midfoot area; (c) a medial sidewall having enhanced traction features, e.g., in the midfoot area; and/or (d) a medial instep component (e.g., medial eye stay reinforcing component) having enhanced traction features.

While aspects of this technology are described in terms of footwear upper components and footwear sole components, additional aspects of this technology relate to methods of making such articles of footwear (e.g., footwear upper components, footwear sole components, etc.).

BRIEF DESCRIPTION OF THE DRAWINGS

The following Detailed Description will be better understood when considered in conjunction with the accompanying drawings in which like reference numerals refer to the same or similar elements in all of the various views in which that reference number appears.

DETAILED DESCRIPTION

Figure 1A:
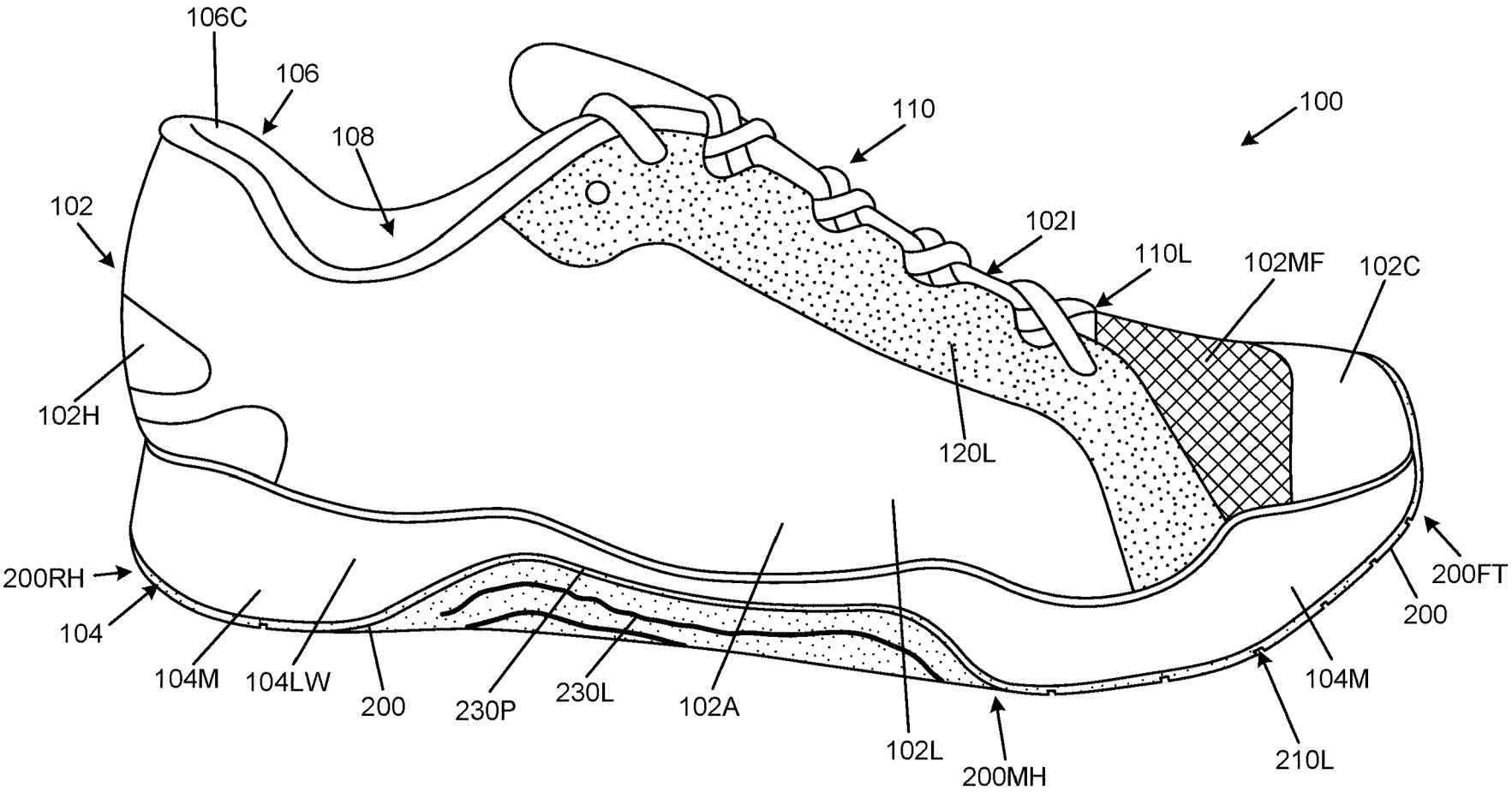
FIGS. 1A-1E provide various views of an article of footwear in accordance with some examples of this technology.

In the following description of various examples of articles of footwear and components thereof according to the present technology, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described structures, functions, and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, etc.), and the like.

This application and/or claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "fourth" in the specification may correspond to any numerical adjective used for that component or feature in the claims).

Various structures and parameters of articles of footwear and components thereof are described based on a "longitudinal length" parameter L. See FIG. 1B. The longitudinal length L can be found with the article of footwear and/or sole structure oriented on a horizontal support surface S on its ground-facing surface in an unloaded condition (e.g., with no weight applied to it other than weight of other components of the article of footwear and/or sole structure). Once so oriented, parallel vertical planes VP that are perpendicular to the horizontal support surface S are oriented to contact the rearmost heel (RH) location(s) and forwardmost toe (FT) location(s) of the article of footwear and/or sole structure. The parallel vertical planes VP should be oriented facing one another, and as far away from one another as possible while still in contact with the rearmost heel RH and forwardmost toe FT locations. The direct distance between these vertical planes VPs corresponds to the length (e.g., a longitudinal length) L of the article of footwear and/or sole structure. The longitudinal length L shown in FIG. 1B is the length of the sole structure 104. The locations of some footwear components are described in this specification based on their respective locations along the longitudinal length L as measured forward from the rear heel vertical plane VP. Thus, the rearmost heel location(s) is (are) located at position 0 L and the forwardmost toe location(s) is (are) located at position 1 L along the longitudinal length L. Intermediate locations along the longitudinal length L are referred to by fractional locations (e.g., 0.25 L) along the longitudinal length L measured forward from the rear heel vertical plane VP. The term "parallel planes" as used herein are planes oriented parallel to the vertical planes VP. These parallel planes may intersect the longitudinal length or longitudinal direction somewhere between P=0 L and P=1.0 L.

The term "rearward" as used herein means at or toward the heel region of the article of footwear (or component thereof), and the term "forward" as used herein means at or toward a forefoot or forward toe region of the article of footwear (or component thereof). The terms "heel," "heel area," or "heel region" as used herein generally refer to a region bounded by parallel planes at 0 L and 0.33 L. The terms "midfoot," "midfoot area," or "midfoot region" as used herein generally refer to a region bounded by parallel planes at 0.33 L and 0.66 L. The terms "forefoot," "forefoot area," or "forefoot region" as used herein generally refer to a region bounded by parallel planes at 0.66 L and 1.0 L. Also, the term "lateral" means the "little toe" side of an article of footwear or component thereof (e.g., an upper, a sole structure, etc.), and the term "medial" means the "big toe" side of an article of footwear or component thereof (e.g., an upper, a sole structure, etc.). The directional terms "upper," "lower," "top," and/or "bottom" and the like, as used herein, unless otherwise noted or clear from the context, refer to a direction or position with the article of footwear and/or other component oriented with its ground-facing surface supported on or facing a horizontal contact surface (e.g., level ground). The term "upper" also is used herein as a noun to refer to a footwear component structure (as conventionally used in the footwear art).

The term "substantially similar" as used herein with respect to width and/or depth dimensional features of grooves means that the noted dimensional feature(s) of one groove is (are) within 15% of that noted dimensional feature (s) of the other groove (e.g., the dimensional feature of one groove is within 15% of the same dimensional feature of the other groove or $D_{1A}=D_{1B}\pm15\%$ or $W_{1A}=W_{1B}\pm15\%$, where $D_{1A}$ is a depth of a first groove, $D_{1B}$ is a depth of a second groove, $W_{1A}$ is a width of a first groove, and $W_{1B}$ is a width of a second groove). In some examples, two (or more) grooves may have these "substantially similar" width or depth features over at least 75% of their lengths. Where groove widths and/or groove depths vary over the length of the groove, the "groove width" will be considered the greatest width present over the groove length being evaluated (e.g., over at least 75% of their lengths) and/or the "groove depth" will be considered the greatest depth present over the groove length being evaluated (e.g., over at least 75% of their lengths). Thus, when comparing widths $W_1$ and $W_2$ of two grooves and either groove width varies, compare the widest $W_1$ of the first groove over the length of the first groove being evaluated against the widest $W_2$ of the second groove over the length of the second groove being evaluated. Similarly, when comparing depths $D_1$ and $D_2$ of two grooves and either groove depth varies, compare the deepest $D_1$ of the first groove over the length of the first groove being evaluated against the deepest $D_2$ of the second groove over the length of the second groove being evaluated.

I. GENERAL DESCRIPTION OF ASPECTS OF THIS TECHNOLOGY

As noted above, aspects of this technology relate to articles of footwear, upper components for articles of footwear, and/or sole components for articles of footwear. At least some of the disclosed articles of footwear, upper components, and/or sole components may be well suited for obstacle course type athletic events (e.g., by providing enhanced traction for various obstacle course events).

Some aspects of this technology relate to sole structures for articles of footwear that include an upper-facing surface and a ground-facing surface opposite the upper-facing surface. At least one of a forefoot support area, a heel support area, and/or a midfoot support area of the sole structure includes: (a) a first plurality of grooves extending from the ground-facing surface toward the upper-facing surface; (b) a second plurality of grooves extending from the ground-facing surface toward the upper-facing surface, wherein grooves of the first plurality of grooves are wider and/or deeper than grooves of the second plurality of grooves; and (c) a base surface extending between the grooves of the first plurality of grooves and the second plurality of grooves, wherein the base surface includes flat or smoothly curved portions extending between the grooves of the first plurality of grooves and the second plurality of grooves. The base surface between the grooves may constitute the bottommost surface of the sole structure and may be arranged to directly contact the ground or other contact surface in use. In such sole structures, the first plurality of grooves, the second plurality of grooves, and the flat or smoothly curved portions of the base surface form at least 75% of a surface area of the ground-facing surface in one or more of the forefoot support area, the heel support area, and/or the midfoot support area. In some examples, the combined first plurality of grooves, second plurality of grooves, and flat or smoothly curved portions of the base surface may form at least 80%, at least 85%, at least 90%, at least 95%, or even up to 100% of a surface area of the ground-facing surface in one or more of the forefoot support area, in the heel support area, in the midfoot support area, and/or in the overall sole structure. In at least some examples of this aspect of the present technology, the grooves of the first plurality of grooves may have substantially similar width and/or depth dimensional features and/or the grooves of the second plurality of grooves may have substantially similar width and/or depth dimensional features (e.g., substantially similar dimensional features over at least 75% of their lengths). Additionally or alternatively, the first plurality of grooves may be wider than the second plurality of grooves over at least 75% of their lengths (e.g., at least 30% wider over at least 75% of the lengths). Additionally or alternatively, the first plurality of grooves may be deeper than the second plurality of grooves over at least 75% of their lengths (e.g., at least 25% deeper over at least 75% of their lengths). The widths and/or depths of grooves of varying widths and/or depths may be compared by comparing the largest width and/or depth present in the first plurality of grooves over the noted length portion with the largest width and/or depth present in the second plurality of grooves over the noted length portion, as described above.

Some aspects of this technology relate to sole structures for articles of footwear that include an upper-facing surface and a ground-facing surface opposite the upper-facing surface. The ground-facing surface at a forefoot support area of some example sole structures will include: (a) a first plurality of grooves (e.g., molded in grooves, cut grooves, etc.) extending from the ground-facing surface toward the upper-facing surface, wherein at least 75% of a length of grooves of the first plurality of grooves have a first width dimension of at least 1 mm (and in some examples, at least 1.5 mm) and less than 5 mm (and in some examples, less than 3 mm) in a direction directly across the respective groove; (b) a second plurality of grooves (e.g., knife cut slits, razor cut slits, or laser cut slits) extending from the ground-facing surface toward the upper-facing surface, wherein at least 75% of a length of grooves of the second plurality of grooves have a second width dimension of less than 1 mm in a direction directly across the respective groove; and (c) a base surface extending between the grooves of the first plurality of grooves and the second plurality of grooves, wherein the base surface includes flat or smoothly curved portions extending between the grooves of the first plurality of grooves and the second plurality of grooves. The base surface between the grooves may constitute the bottommost surface of the sole structure and may be arranged to directly contact the ground or other contact surface in use. In such structures, the first plurality of grooves, the second plurality of grooves, and the flat or smoothly curved portions of the base surface form at least 75% of a surface area of the ground-facing surface in the forefoot support area. In some examples, the combined first plurality of grooves, second plurality of grooves, and flat or smoothly curved portions of the base surface may form at least 80%, at least 85%, at least 90%, at least 95%, or even up to 100% of a surface area of the ground-facing surface in the forefoot support area. In at least some examples of this aspect of the present technology, the grooves of the first plurality of grooves may have substantially similar width and/or depth dimensional features and/or the grooves of the second plurality of grooves may have substantially similar width and/or depth dimensional features (e.g., over at least 75% of their respective lengths). Additionally or alternatively, in some examples of this technology, the first width dimension of the first plurality of grooves may be at least 30% greater than the second width dimension of the second plurality of grooves (wherein grooves of varying width may be compared by comparing the largest widths of the groove sets over the groove lengths being evaluated).

Some additional or alternative aspects of this technology relate to sole structures for articles of footwear that include an upper-facing surface and a ground-facing surface opposite the upper-facing surface, wherein a heel support area of the sole structures includes: (a) a first plurality of grooves (e.g., molded in grooves, cut grooves, etc.) extending from the ground-facing surface toward the upper-facing surface, wherein at least 75% of a length of grooves of the first plurality of grooves have a first width dimension of at least 1 mm (and in some examples, at least 1.5 mm) and less than 5 mm (and in some examples, less than 3 mm) in a direction directly across the respective groove; (b) a second plurality of grooves (e.g., knife cut slits, razor cut slits, or laser cut slits) extending from the ground-facing surface toward the upper-facing surface, wherein at least 75% of a length of grooves of the second plurality of grooves have a second width dimension of less than 1 mm in a direction directly across the respective groove; and (c) a base surface extending between the grooves of the first plurality of grooves and the second plurality of grooves, wherein the base surface includes flat or smoothly curved portions extending between the grooves of the first plurality of grooves and the second plurality of grooves. The base surface between the grooves may constitute the bottommost surface of the sole structure and may be arranged to directly contact the ground or other contact surface in use. In such structures, the first plurality of grooves, the second plurality of grooves, and the flat or smoothly curved portions of the base surface form at least 75% of a surface area of the ground-facing surface in the heel support area. In some examples, the combined first plurality of grooves, second plurality of grooves, and flat or smoothly curved portions of the base surface may form at least 80%, at least 85%, at least 90%, at least 95%, or even up to 100% of a surface area of the ground-facing surface in the heel support area. In at least some examples of this aspect of the present technology, the grooves of the first plurality of grooves may have substantially similar width and/or depth dimensional features and/or the grooves of the second plurality of grooves may have substantially similar width and/or depth dimensional features (e.g., over at least 75% of their respective lengths). Additionally or alternatively, in some examples of this technology, the first width dimension of the first plurality of grooves may be at least 30% greater than the second width dimension of the second plurality of grooves (wherein grooves of varying width may be compared by comparing the largest widths of the groove sets over the groove lengths being evaluated).

Also, in some examples of this technology, the features of the forefoot support area described above and the features of the heel support area described above may be present in the same sole structure. In other words, both the forefoot support area and the heel support area of a single sole structure may have the features noted above. In such structures, the first plurality of grooves, the second plurality of grooves, and the flat or smoothly curved portions of the base surface also may be provided and/or also may extend through the midfoot area (e.g., to form a support surface configured to support an entire plantar surface of a wearer's foot). In at least some examples of such sole structures, the first plurality of grooves, the second plurality of grooves, and the flat or smoothly curved portions of the base surface may form at least 75% of a surface area of the entire ground-facing surface of the sole structure. Further, in such examples, the combined first plurality of grooves, second plurality of grooves, and flat or smoothly curved portions of the base surface may form at least 80%, at least 85%, at least 90%, at least 95%, or even up to 100% of a surface area of the ground-facing surface of the entire sole structure.

In addition to or as an alternative to generally being wider over at least 75% of their lengths (e.g., at least 30% wider), in some examples of this technology, the first plurality of grooves may be generally deeper than the second plurality of grooves over at least 75% of their lengths. As some more specific examples, sole structures of the types described above (e.g., an outsole component) may include a sole thickness dimension corresponding to a direct distance between the upper-facing surface and the ground-facing surface. In such structures: (a) at least 75% of the length of the grooves of the first plurality of grooves may have a first depth dimension of at least 30% of the sole thickness dimension (and in some examples, at least 50% of the sole thickness dimension) and/or (b) at least 75% of the length of the grooves of the second plurality of grooves may have a second depth dimension of less than 30% of the sole thickness dimension (and in some examples, less than 25% of the sole thickness). The individual grooves of the first plurality of grooves and/or the second plurality of grooves may be straight and/or curved. The first plurality of grooves may be at least 25% deeper than the second plurality of grooves over at least 75% of the grooves' lengths.

The sole structures described above may form an outsole component and the ground-contacting surface of an article of footwear. Such sole structures may be made from a rubber material, including rubber materials formulated and/or selected to possess and/or treated to include increased tackiness and/or an increased coefficient of friction with respect to certain materials (e.g., materials expected to be present in one or more obstacle course events).

In at least some examples of this technology, the upper-facing surface and the ground-facing surface of the sole structure(s) (the outsole component) may extend continuously from the bottom of the sole structure to form one or both of an upwardly extending lateral sidewall and/or an upwardly extending medial sidewall of the sole structure. When present, at least the upwardly extending medial sidewall may include a concave exterior surface (e.g., formed from the material of the ground-facing surface of the sole structure), e.g., a smoothly curved concave exterior surface at a midfoot support area of the sole structure. This concave exterior surface may have a surface area of at least 10 $cm^2$ (and in some examples, at least 15 $cm^2$ or even at least 20 $cm^2$) in the midfoot support area. At least some portion of the concave exterior medial sidewall surface (and optionally the entire ground-facing surface of the sole structure or the forefoot support area of the ground-facing surface) may be made from a rubber material, including rubber materials formulated and/or selected to possess and/or treated to include increased tackiness and/or an increased coefficient of friction with respect to certain materials (e.g., materials expected to be present in one or more obstacle course events), such as a rope material used in obstacles requiring rope climbing.

Some additional or alternative aspects of this technology relate to articles of footwear that include: (a) an upper including an instep region; (b) a medial eye stay reinforcement including one or more lace-engaging components located at a medial side of the instep region, wherein the medial eye stay reinforcement defines a surface area of at least 6 $cm^2$ (and in some examples, at least 10 $cm^2$ or even at least 15 $cm^2$) having a higher coefficient of friction than an upper material located immediately adjacent the medial eye stay reinforcement; and (c) a sole structure engaged with the upper. The sole structure may include an outsole component forming at least 33% of a ground-contacting surface of the sole structure, wherein material of the ground-contacting surface extends continuously from the ground-contacting surface, around a medial side edge of the sole structure, and forms an upwardly extending medial sidewall of the sole structure in a medial midfoot area of the article of footwear. This upwardly extending medial sidewall may include a concave exterior surface formed of the material of the ground-contacting surface, e.g., a smoothly curved concave exterior surface forming a side surface having a surface area of at least 10 $cm^2$ (and, in some examples, at least 15 $cm^2$ or even at least 20 $cm^2$) formed from the material of the ground-contacting surface. At least some portion of the concave exterior surface (and optionally the entire ground-facing surface of the sole structure or the forefoot support area of the ground-facing surface) may be made from a material (e.g., a rubber material, a thermoplastic polyurethane material, etc.) formulated and/or selected to possess and/or treated to include increased tackiness and/or an increased coefficient of friction with respect to certain materials (e.g., materials expected to be contacted in one or more obstacle course events), such as a rope material used in obstacles requiring rope climbing. The sole structure according to this example aspect of the present technology may have any of the features of the sole structures described above.

Still additional or alternative aspects of this technology may include articles of footwear having: (a) an upper including an instep region; (b) a medial eye stay reinforcement including one or more lace-engaging components located at a medial side of the instep region, wherein the medial eye stay reinforcement defines a surface area of at least 6 $cm^2$ (and in some examples, at least 10 $cm^2$ or even at least 15 $cm^2$) having a higher coefficient of friction than an upper material located immediately adjacent the medial eye stay reinforcement; and (c) an upwardly extending medial sidewall in a medial midfoot area of the article of footwear. This upwardly extending medial sidewall may include a concave exterior surface, e.g., a smoothly curved concave exterior surface forming a side surface having a surface area of at least 10 $cm^2$ (and in some examples, at least 15 $cm^2$ or even at least 20 $cm^2$). At least some portion of the concave exterior surface may be made from a material (e.g., a rubber material, a thermoplastic polyurethane material, etc.) formulated and/or selected to possess and/or treated to include increased tackiness and/or an increased coefficient of friction with respect to certain materials (e.g., materials expected to be contacted in one or more obstacle course events), such as a rope material used in obstacles requiring rope climbing. Additionally or alternatively, at least some portion of this upwardly extending medial sidewall in the medial midfoot area may include traction elements (e.g., raised ribs, recessed grooves, raised nubs, etc.). This upwardly extending medial sidewall may constitute a portion of a sole component of the article of footwear (e.g., a portion of an outsole component, a portion of a midsole component, etc.); may constitute a separate part engaged with the upper and/or sole structure; may originate at or near a bottom edge of the upper; and/or may extend around from a side surface of the upper or sole structure to a bottom surface of the upper, to a bottom surface of the sole structure, and/or to a bottom surface of the article of footwear.

Given the general description of features, examples, aspects, structures, processes, and arrangements according to certain aspects and examples of this technology provided above, a more detailed description of specific example sole structures, articles of footwear, and/or methods in accordance with this technology follows.

II. DETAILED DESCRIPTION OF EXAMPLE ARTICLES OF FOOTWEAR AND COMPONENTS/FEATURES ACCORDING TO ASPECTS OF THIS TECHNOLOGY

Referring to the figures and following discussion, examples of footwear upper components, foot support components, sole structures, and articles of footwear in accordance with aspects of this technology are described.

Figure 1B:
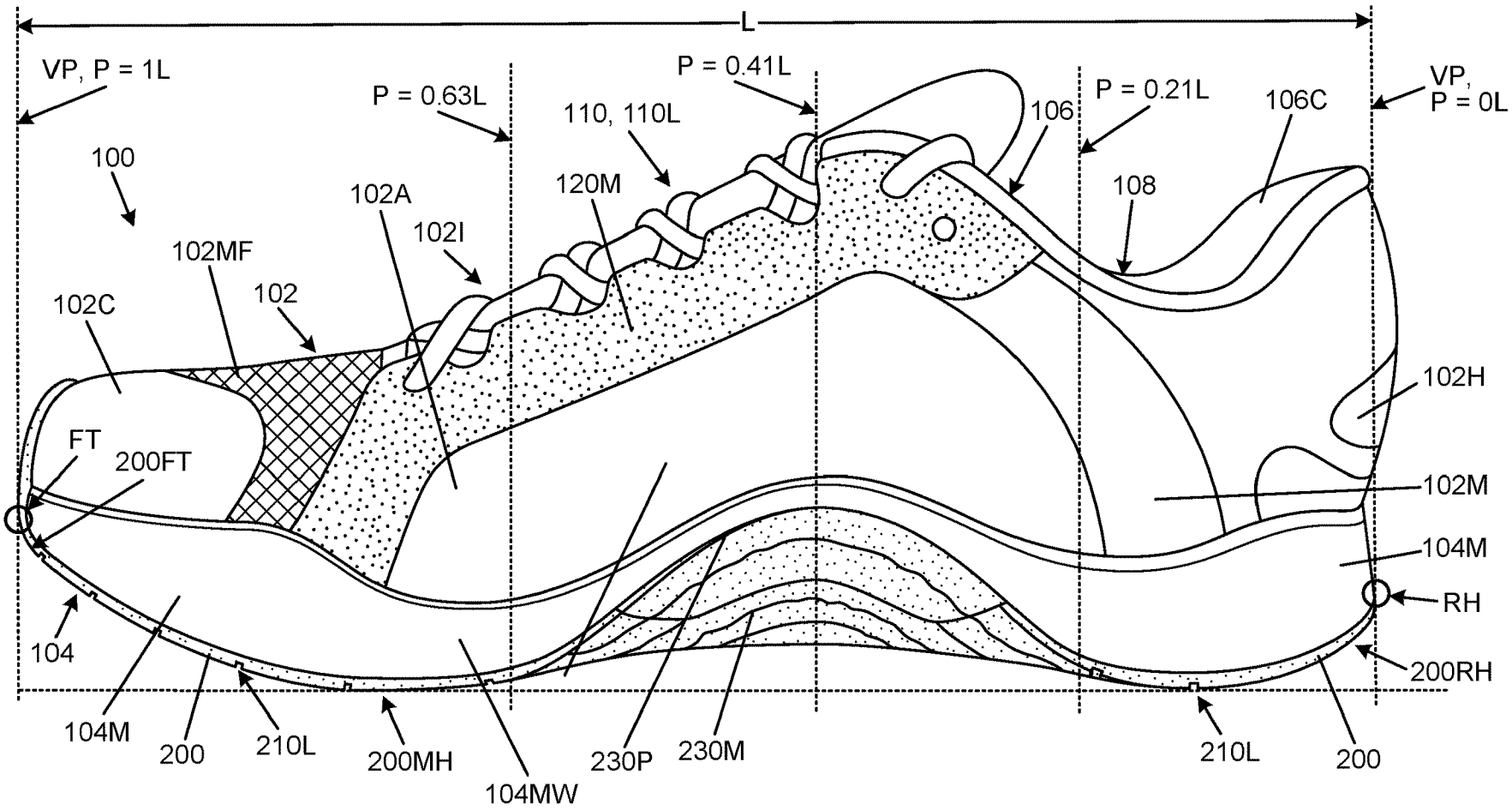
Figure 1C:
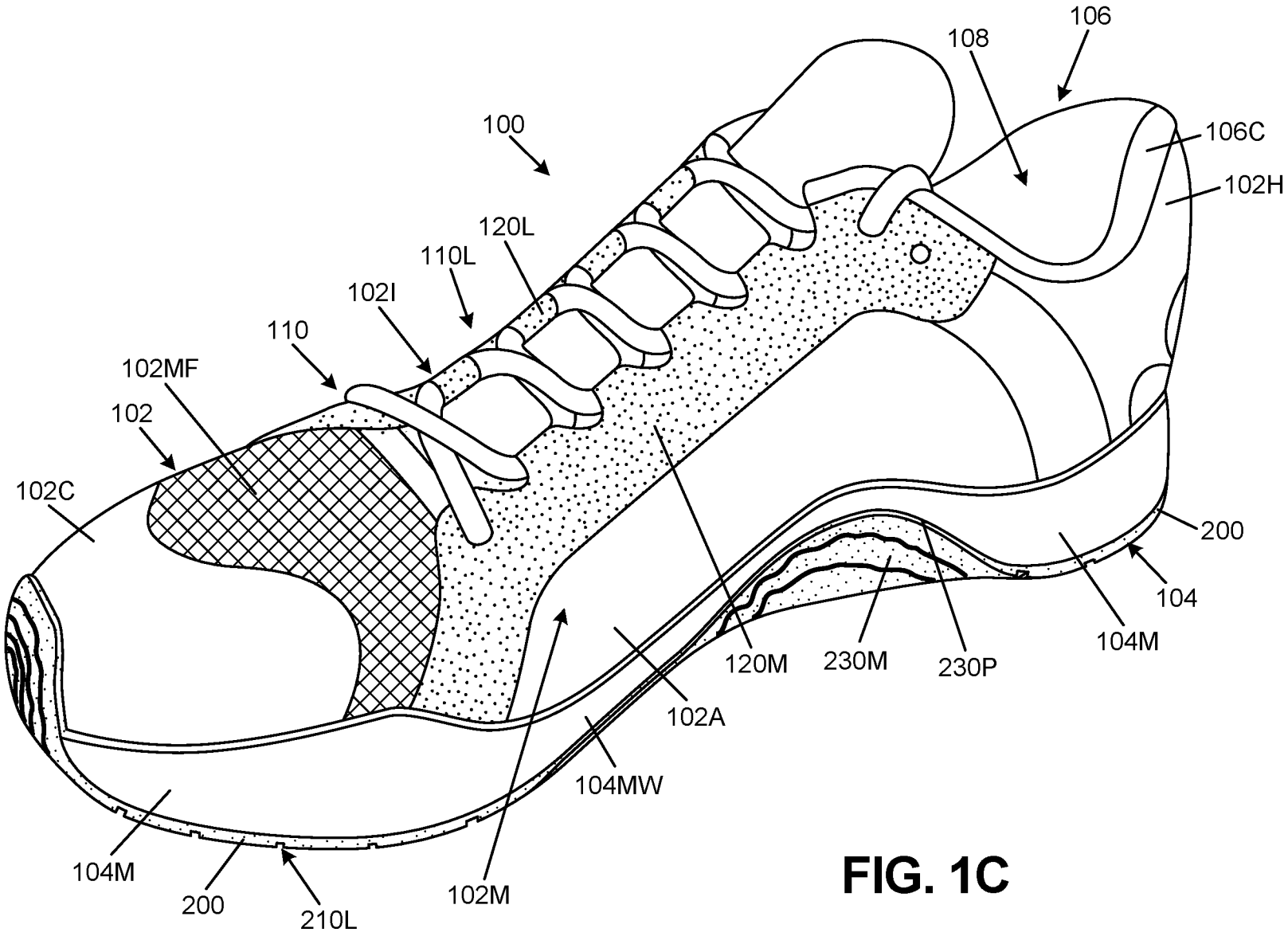
Figure 1D:
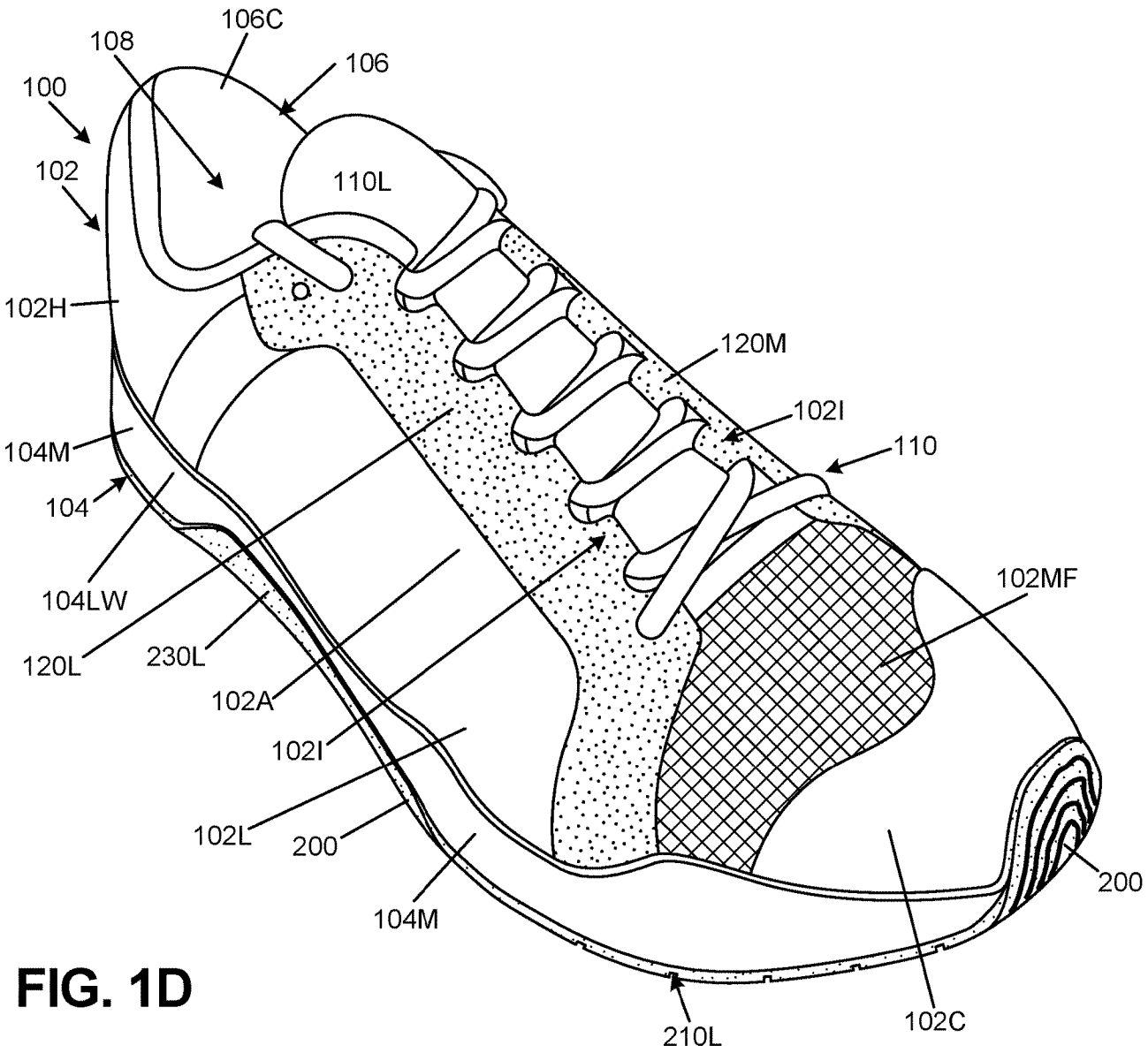
Figure 1E:
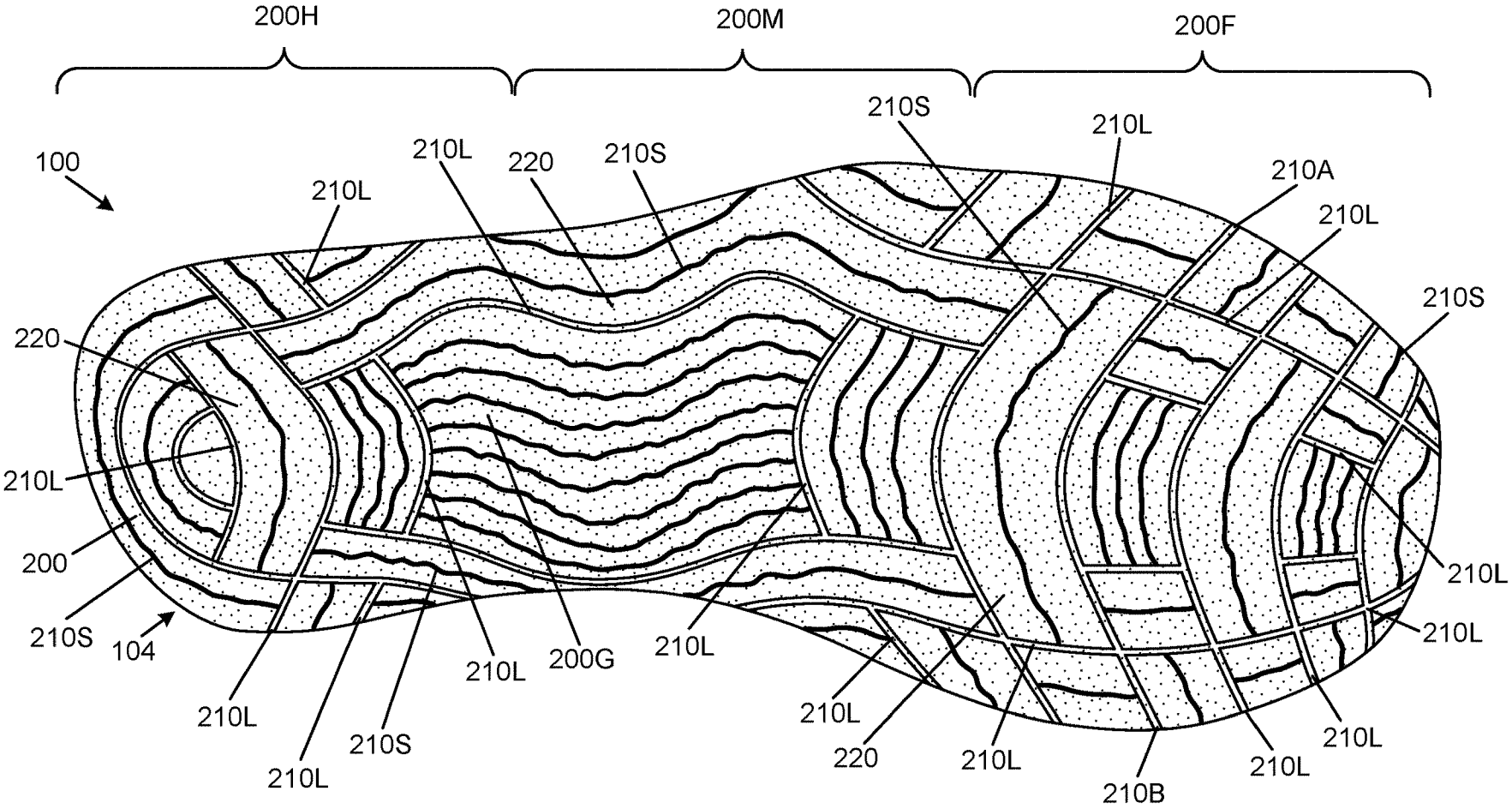

FIGS. 1A-1E illustrate a first example article of footwear 100 in accordance with aspects of this technology. FIG. 1A provides a lateral side view; FIG. 1B provides a medial side view; FIG. 1C provides a front, medial perspective view; FIG. 1D provides a front, lateral perspective view; and FIG. 1E provides a bottom view of the article of footwear 100. The article of footwear 100 includes an upper 102 (comprising one or more component parts) and a sole structure 104 (comprising one or more component parts) engaged with the upper 102. The upper 102 at least in part defines a foot-receiving opening 106 that provides access to an interior chamber 108 configured to receive a wearer's foot. A lace type closure system 110 (including a lace 110L) is engaged with the upper 102 at an instep region 102I of the upper 102.

The upper 102 may have any desired construction, materials, component parts, and/or structures in accordance with some aspects of this technology. For example, FIGS. 1A-1D show various footwear upper 102 components fixed tougher by sewn seams. Additionally, FIGS. 1A-1D show an upper 102 including a mesh material 102MF (or other breathable material) in the forefoot, an abrasion resistant toe cap 102C, one or more lateral side 102L panels, one or more medial side 102M panels, one or more heel panels 102H, and a comfort-enhancing collar 106C (e.g., including a foam material with a soft fabric cover). Some of these components may be conventional structures, may be formed of conventional materials (e.g., fabrics, leathers, thermoplastic polyurethanes, other polymers, etc.), and/or may be formed and engaged together in conventional manners (e.g., using sewing or stitching, using fusing techniques, using adhesives, using mechanical connectors, etc.), as are known and used in the footwear arts. The upper 102 component parts may have any desired size, shapes, arrangements, and/or number of parts, e.g., to take on a wide variety of ornamental and aesthetic appearances. At least some aspects of this technology, however, include upper features and combinations of features that will be described in more detail below.

The sole structure 104 of this example includes a midsole component 104M and an outsole component 200. The midsole component 104M may be made of any desired materials, may include any desired construction, and may be formed in any desired manner, including conventional materials, conventional constructions, and conventional production techniques as are known and used in the footwear arts. As some more specific examples, the midsole component 104M may include one or more of: one or more polymeric foam materials (e.g., an ethylvinylacetate (EVA) foam, a polyurethane foam, etc.) or component parts; one or more fluid-filled bladder or other gas-containing components; one or more mechanical shock absorbing components; etc. The illustrated example of FIGS. 1A-1E includes a polymeric foam midsole component 104M (e.g., made from EVA), which optionally may include one or more internal fluid-filled bladders.

The outsole component 200 now will be described in more detail with additional reference to FIGS. 2A and 2B. As shown, the outsole component 200 includes an upper-facing surface 200U and a ground-facing surface 200G opposite the upper-facing surface 200U. The outsole component 200 may be formed from a rubber or rubber base material as will be described in more detail below. In this illustrated example, as shown in FIGS. 1A-1E, the outsole component 200 (including the upper-facing surface 200U and the ground-facing surface 200G) extends continuously (e.g., as a single part) to form a forefoot support area 200F (FIG. 1E), a heel support area 200H, and a midfoot support area 200M between (and connecting) the forefoot support area 200F and the heel support area 200H. Thus, this example outsole component 200 (including the upper-facing surface 200U and the ground-facing surface 200G) extends continuously and forms a support surface configured to support an entire plantar surface of a wearer's foot.

Figure 2A:
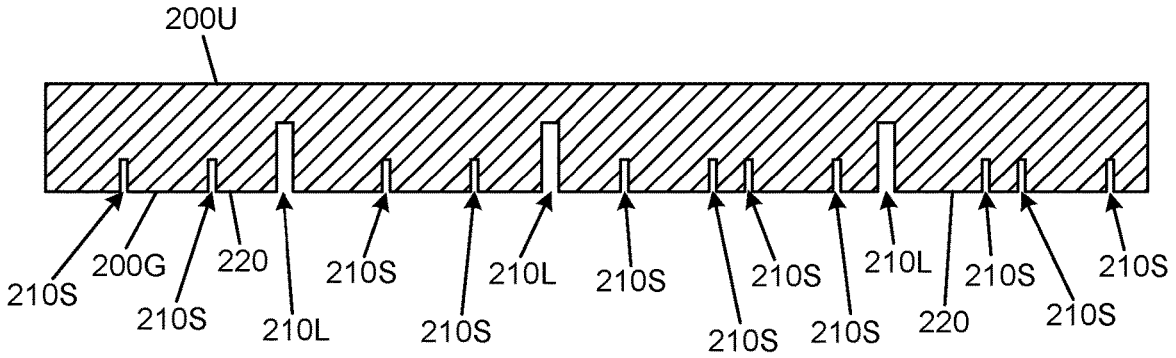
FIGS. 2A and 2B provide generic cross sectional views to illustrate additional features of grooves provided in sole structures in accordance with some examples of this technology.
Figure 2B:
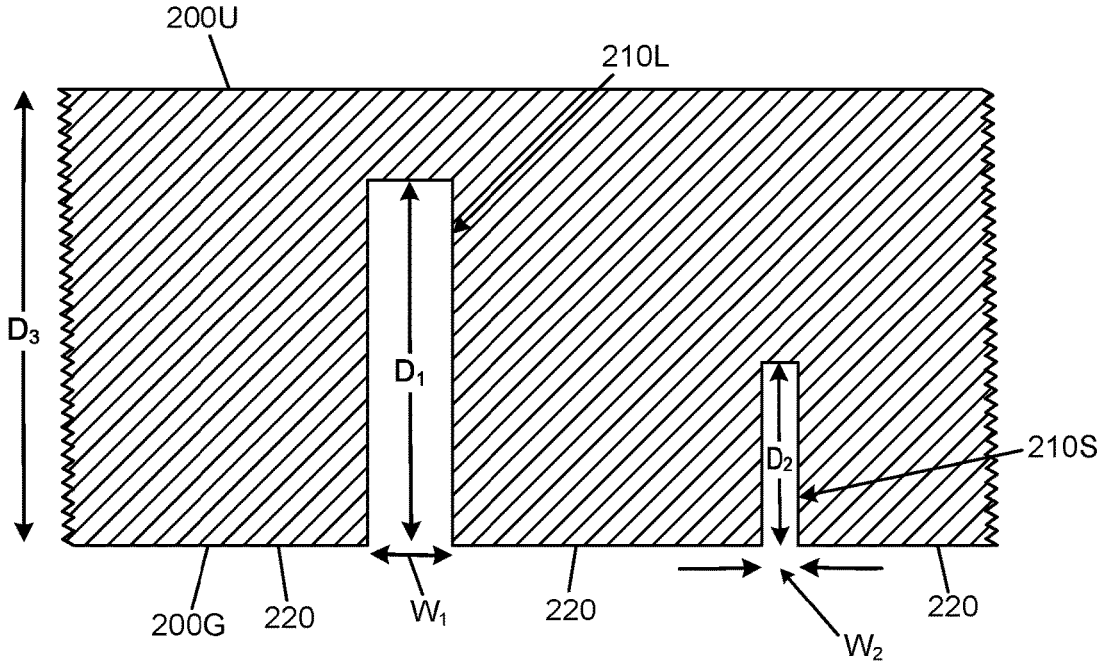

As shown in FIGS. 1E, 2A, and 2B, various areas of the ground-facing surface 200G of the outsole component 200 (e.g., the forefoot support area 200F, the heel support area 200H, the midfoot support area 200M) include grooves extending upward from the ground-facing surface 200G toward the upper-facing surface 200U. Two general types of grooves are shown in these figures: a plurality of "large grooves" 210L and a plurality of "small grooves" 210S (relative to one another). The grooves present in the plurality of "large grooves" 210L may have substantially similar width and/or depth dimensional features (e.g., at least 75% of the length of one groove of the plurality of large grooves 210L may have substantially similar width and/or substantially similar depth dimensions compared to the width and/or depth dimensions of at least 75% of the length of another groove (or other grooves) of the plurality of large grooves 210L). Additionally or alternatively, the grooves present in the plurality of "small grooves" 210S may have substantially similar width and/or substantially similar depth dimension features (e.g., at least 75% of the length of one groove of the plurality of small grooves 210S may have substantially similar width and/or depth dimensions compared to the width and/or depth dimensions of at least 75% of the length of another groove (or other grooves) of the plurality of small grooves 210S).

Additional example features of the grooves now will be described. As shown in FIGS. 2A and 2B, each of the grooves 210L, 210S includes a depth dimension $D_1$ and $D_2$, respectively, extending inward (and upward) from the ground-facing surface 200G toward (but not to) the upper-facing surface 200U. Additionally, each of the grooves 210L, 210S includes a width dimension $W_1$ and $W_2$, respectively, extending directly across the groove from one side to the opposite side. Each of the grooves 210L, 210S also includes a length dimension, e.g., the long dimension extending along the ground-facing surface 200G as shown in FIG. 1E (the length dimension extending from one end 210A of an individual groove to an opposite end 210B of that individual groove along the bottom of the outsole component 200). As further shown in FIG. 1E, the grooves 210L, 210S may be straight or curved over their length dimension. The widths and/or depths of grooves 210L, 210S may vary over the length of the groove 210L, 210S.

In the specific examples shown in FIGS. 1E-2B, a first plurality of the grooves (the "larger grooves" 210L) extend from the ground-facing surface 200G toward the upper-facing surface 200U, and at least 75% of a length of grooves of this first plurality of grooves 210L have a first width dimension $W_1$ of at least 1 mm and less than 5 mm in a direction directly across the respective groove 210L. Thus, while the groove width $W_1$ may vary over the groove 210L's length, at least 75% of the overall length of the groove 210L will have a width dimension between 1 mm and 5 mm. In some examples, this width $W_1$ dimension over at least 75% of the groove 210L's length will be within the range of 1.25 mm and 4 mm, within the range of 1.5 mm and 3 mm, within a range of 2 mm and 4 mm, or the like. Additionally or alternatively, a second plurality of grooves (the "smaller grooves" 210S) extend from the ground-facing surface 200G toward the upper-facing surface 200U, and at least 75% of a length of grooves of this second plurality of grooves 210S have a second width dimension $W_2$ of less than 1 mm in a direction directly across the respective groove 210S. Thus, while the groove width $W_2$ may vary over the groove 210S's length, at least 75% of the overall length of the groove 210S will have a width dimension of less than 1 mm. In some examples, this width $W_2$ dimension over at least 75% of the groove 210S's length will be less than 1 mm, less than 0.75 mm, or even less than 0.5 mm. In some examples, the smaller grooves 210S may be formed as narrow slits, e.g., knife cut slits, razor cut slits, or laser cut slits. The widths $W_1$ and/or $W_2$ may fall within the various width dimensional ranges described above over at least 50%, at least 60%, at least 70%, at least 80%, at least 90%, at least 95%, or even up to 100% of the groove 210L's and/or 210S's total length.

The grooves also may have various groove depth characteristics. For example, the first plurality of the grooves (the "larger grooves" 210L) may extend from the ground-facing surface 200G toward the upper-facing surface 200U to a first depth dimension $D_1$ wherein the first depth dimension $D_1$ is at least 30% of the overall outsole component thickness $D_3$ from the upper-facing surface 200U to the ground-facing surface 200G (i.e., $D_1 \geq 0.3 \times D_3$). See FIG. 2B. In other examples:

| | | |
|---|---|---|
| $0.95 \times D_3 > D_1 \geq 0.3 \times D_3$ | $0.95 \times D_3 > D_1 \geq 0.4 \times D_3$ | $0.95 \times D_3 > D_1 \geq 0.5 \times D_3$ |
| $0.95 \times D_3 > D_1 \geq 0.6 \times D_3$ | $0.95 \times D_3 > D_1 \geq 0.7 \times D_3$ | $0.95 \times D_3 > D_1 \geq 0.8 \times D_3$ |
| $0.9 \times D_3 > D_1 \geq 0.3 \times D_3$ | $0.9 \times D_3 > D_1 \geq 0.4 \times D_3$ | $0.9 \times D_3 > D_1 \geq 0.5 \times D_3$ |
| $0.9 \times D_3 > D_1 \geq 0.6 \times D_3$ | $0.9 \times D_3 > D_1 \geq 0.7 \times D_3$ | $0.9 \times D_3 > D_1 \geq 0.8 \times D_3$ |

The depth dimension ranges $D_1$ described above may be present over at least 75% of the length of the grooves of the first plurality of grooves 210L, with the sole thickness $D_3$ measurements being made at the location immediately surrounding where the corresponding groove depth dimension $D_1$ is being taken. The groove depth $D_1$ (and the outsole component thickness $D_3$) may vary over the overall length of a respective groove, but at least 75% of the groove 210L's length will have one or more of the above depth dimension ratio characteristics, in some examples of this technology. Alternatively, the depth $D_1$ may fall within the various depth dimensional ratio ranges described above over at least 50%, at least 60%, at least 70%, at least 80%, at least 90%, at least 95%, or even up to 100% of the groove 210L's total length. Further, as shown in FIGS. 1A-1E, at least some of the larger grooves 210L may extend to and open at the side edge of the outsole component 200. This may help discharge water forced into the groove 210L out from beneath the sole structure 104 and out from a location between the sole structure 104 and the contact surface.

The second plurality of grooves (the "smaller grooves" 210S) also may have various groove depth characteristics. In some examples, and as shown in FIG. 2B, the second plurality of the grooves 210S may extend from the ground-facing surface 200G toward the upper-facing surface 200U to a second depth dimension $D_2$ wherein the second depth dimension $D_2$ is less than 30% of the overall outsole component thickness $D_3$ from the upper-facing surface 200U to the ground-facing surface 200G (i.e., $D_2 \leq 0.3 \times D_3$). In other examples:

| | | |
|---|---|---|
| $0.3 \times D_3 > D_2 \geq 0.05 \times D_3$ | $0.3 \times D_3 > D_2 \geq 0.1 \times D_3$ | $0.3 \times D_3 > D_2 \geq 0.15 \times D_3$ |
| $0.25 \times D_3 > D_2 \geq 0.05 \times D_3$ | $0.25 \times D_3 > D_2 \geq 0.1 \times D_3$ | $0.25 \times D_3 > D_2 \geq 0.15 \times D_3$ |
| $0.4 \times D_3 > D_2 \geq 0.05 \times D_3$ | $0.4 \times D_3 > D_2 \geq 0.1 \times D_3$ | $0.4 \times D_3 > D_2 \geq 0.15 \times D_3$ |
| $0.5 \times D_3 > D_2 \geq 0.1 \times D_3$ | $0.5 \times D_3 > D_2 \geq 0.2 \times D_3$ | $0.5 \times D_3 > D_2 \geq 0.3 \times D_3$ |

The depth dimension ranges $D_2$ described above may be present over at least 75% of the length of the grooves of the second plurality of grooves 210S, with the sole thickness $D_3$ measurements being made at the location immediately surrounding where the corresponding groove depth dimension $D_2$ is being taken. The groove depth $D_2$ (and the outsole component thickness $D_3$) may vary over the overall length of a respective groove 210S, but at least 75% of the groove 210S's length will have one or more of the above depth dimension ratio characteristics in some examples of this technology. Alternatively, the depth $D_2$ may fall within the various depth dimensional ratio ranges described above over at least 50%, at least 60%, at least 70%, at least 80%, at least 90%, at least 95%, or even up to 100% of the groove 210S's total length. Further, as shown in FIG. 1E, at least some of the smaller grooves 210S may extend to and open at the side edge of the outsole component 200 (e.g., to help discharge water).

Other features of this example outsole component 200 relate to the area between grooves 210L, 210S. As shown in FIGS. 1E-2B, in at least some examples of this technology, a base surface 220 extends between the grooves 210L, 210S (e.g., between adjacent larger grooves 210L, between adjacent smaller grooves 210S, and between adjacent larger grooves 210L and smaller grooves 210S). This base surface 220 includes flat or smoothly curved portions extending between the grooves 210L, 210S. The base surface 220 forms the bottommost surface and bottommost extent of the sole structure 104 in this illustrated example (when the sole structure 104) is oriented on a support surface S in an unloaded condition, e.g., as shown in FIG. 1B). Thus, the base surface 220 may be arranged to directly contact the ground or other contact surface in use.

In at least some example outsole components 200 in accordance with this technology: (a) the first plurality of grooves (the larger grooves 210L), the second plurality of grooves (the smaller grooves 210S), and the flat or smoothly curved portions of the base surface 220 will form at least 70% of a surface area of the ground-facing surface 200G of the outsole component 200 in the forefoot support area 200F; (b) the first plurality of grooves (the larger grooves 210L), the second plurality of grooves (the smaller grooves 210S), and the flat or smoothly curved portions of the base surface 220 will form at least 70% of a surface area of the ground-facing surface 200G of the outsole component 200 in the heel support area 200H; (c) the first plurality of grooves (the larger grooves 210L), the second plurality of grooves (the smaller grooves 210S), and the flat or smoothly curved portions of the base surface 220 will form at least 70% of a surface area of the ground-facing surface 200G of the outsole component 200 in the midfoot support area 200M; and/or (d) the first plurality of grooves (the larger grooves 210L), the second plurality of grooves (the smaller grooves 210S), and the flat or smoothly curved portions of the base surface 220 will form at least 70% of a surface area of the ground-facing surface 200G of the entire outsole component 200.

In any one or more of the forefoot support area 200F, the heel support area 200H, the midfoot support area 200M, and/or the entire ground-facing surface 200G of the outsole component 200, the first plurality of grooves (the larger grooves 210L), the second plurality of grooves (the smaller grooves 210S), and the flat or smoothly curved portions of the base surface 220 may form at least 75%, at least 80%, at least 85%, at least 90%, at least 95%, or even up to 100% of the surface area of the ground-facing surface 200G. In other words, the ground-facing surface 200G of the outsole component may consist essentially of or consist only of the first plurality of grooves (the larger grooves 210L), the second plurality of grooves (the smaller grooves 210S), and the flat or smoothly curved portions of the base surface 220. Additionally or alternatively, as shown in FIG. 1E, the ground-contacting surface 200G may be devoid of traction elements other than traction features provided by the first plurality of grooves (the larger grooves 210L), the second plurality of grooves (the smaller grooves 210S), and the flat or smoothly curved portions of the base surface 220. Thus, in any one or more of the forefoot support area 200F, the heel support area 200H, the midfoot support area 200M, and/or the entire ground-facing surface 200G of the outsole component, the flat or smoothly curved portions of the base surface 220 may form at least 70%, at least 75%, at least 80%, at least 85%, or even at least 90% of the surface area of the ground-facing surface 200G. This base surface 220 also may constitute the bottommost extent of the sole structure 104 and/or article of footwear 100. Also, in at least some examples of this technology, no components (e.g., traction elements, etc.) will be engaged with the base surface 220.

As noted above, the base surface 220 may be flat or smoothly curved between the first plurality of grooves and the second plurality of grooves. "Flat" means planar when referring to a two-dimensional area or linear when referring to a one directional area (e.g., the base surface 220 may be "flat" in a side-to-side direction but have curvature in a front-to-back direction). "Smoothly curved" as that term is used herein means the surface has no abrupt changes in direction, such as direction changes needed to form a traction element or direction changes needed to form a raised rib or a recessed groove. Thus, in accordance with at least some aspects of this technology, at least 70%, at least 75%, at least 80%, at least 85%, at least 90%, at least 95%, or even up to 100% of the surface area of the base surface 220 of the ground-facing surface 200G will be flat or smoothly curved between the first plurality of grooves (the larger grooves 210L) and the second plurality of grooves (the smaller grooves 210S). The term "smoothly curved" as used herein permits some surface roughness and/or surface texturing, but within the flat or smoothly curved base surface 220, areas having abrupt corners (e.g., sharp edged corners) and/or tightly radiused edges (thereby creating substantial surface depth changes) should be avoided or omitted. As evident from FIG. 1E, the ground-facing surface 200G of this example outsole component 200 has a very flat structure over a large proportion of its surface area (e.g., over the surface area ranges described above).

As noted above, the base surface 220 may be flat or substantially flat in one direction (e.g., the side-to-side direction) but smoothly curved in another direction (e.g., the front-to-back direction). FIGS. 1A and 1B illustrate that the forefoot support area 200F of the outsole component 200 of this example curves upward in a back-to-front direction of the outsole component 200, e.g., in a direction from a metatarsal head support area 200MH to a forward toe area 200FT of the outsole component 200. Additionally, FIGS. 1A and 1B illustrate that the heel support area 200H of the outsole component 200 of this example curves upward in a front-to-back direction of the outsole component 200, e.g., in a direction from a central heel support area to a rear heel area 200RH of the outsole component 200.

While other groove shapes are possible, as shown in FIG. 1E, in the forefoot support area 200F and the midfoot support area 200M, at least some of the first plurality of grooves (the larger grooves 210L) and at least some of the second plurality of grooves (the smaller grooves 210S) are curved in this example outsole component 200. The apices of the curves are located more rearward in the outsole component 200 structure than the ends. Thus, some of the first plurality of grooves (the larger grooves 210L) and some of the second plurality of grooves (the smaller grooves 210S) have a general U-shape with the arms of the "U-shape" arranged and extending forward toward a forward toe end of the outsole component 200. Also, at least some of the second plurality of grooves (the smaller grooves 210S) have a "curve-within-a curve" structure, e.g., some of the smaller grooves 210S have a shape akin to a sine wave.

As another example feature (and while other groove shapes are possible), in the heel support area 200H: (a) some of the first plurality of grooves (the larger grooves 210L) and some of the second plurality of grooves (the smaller grooves 210S) are curved with apices of the curves located more forward in the outsole component 200 structure than the ends of the curves and (b) some of the first plurality of grooves (the larger grooves 210L) and some of the second plurality of grooves (the smaller grooves 210S) are curved with apices of the curves located more rearward in the outsole component 200 structure than the ends of the curves. Thus: (a) some of the first plurality of grooves (the larger grooves 210L) and some of the second plurality of grooves (the smaller grooves 210S) have a general U-shape with the arms of the "U-shape" arranged and extending rearward toward a rear heel end of the outsole component 200 and (b) some of the first plurality of grooves (the larger grooves 210L) and some of the second plurality of grooves (the smaller grooves 210S) have a general U-shape with the arms of the "U-shape" arranged and extending forward toward a forward toe end of the outsole component 200. Also, at least some of the second plurality of grooves (the smaller grooves 210S) have a "curve-within-a curve" structure, e.g., some of the smaller grooves 210S have a shape akin to a sine wave.

In the midfoot support area 200M of this example, the first plurality of grooves (the larger grooves 210L) and the second plurality of grooves (the smaller grooves 210S) extend in substantially the front-to-back direction of the outsole component 200. These grooves 210L, 210S may be straight, curved, sine wave shaped, and/or have other desired shape(s).

In accordance with some aspects of this technology, the outsole component 200 (or at least the ground-facing surface 200G thereof) may be treated with a tackiness-enhancing material and/or formed from a tackiness-enhanced material. Such material(s) may increase the coefficient of friction of the outsole component 200 with respect to a contact surface that the ground-facing surface 200G is expected to encounter during use. As noted above, some aspects of this technology may be used for footwear used in obstacle course type events. Some obstacle courses have participants attempt to scale a curved wall (e.g., the "Warped Wall" and the "Mega Wall" structures used in some American Ninja Warrior competitions). Thus, the outsole component 200 may be formed from a material (e.g., a rubber material that optionally may be modified or selected to have enhanced tackiness) and/or treated (e.g., coated or sprayed with a material) to increase the coefficient of friction between the ground-contacting surface 200G and the material of the wall surface to be scaled. When used, the tackiness-enhanced materials and/or coatings may be selected to balance desired properties, e.g., to increase tackiness and/or the coefficient of friction with respect to a specific surface while not excessively reducing durability and/or while not being so tacky as to undesirably collect dust and/or other debris. In some examples, the outsole component 200 may be made from a rubber or TPU compound (e.g., a relatively soft rubber or TPU component).

Figure 3:
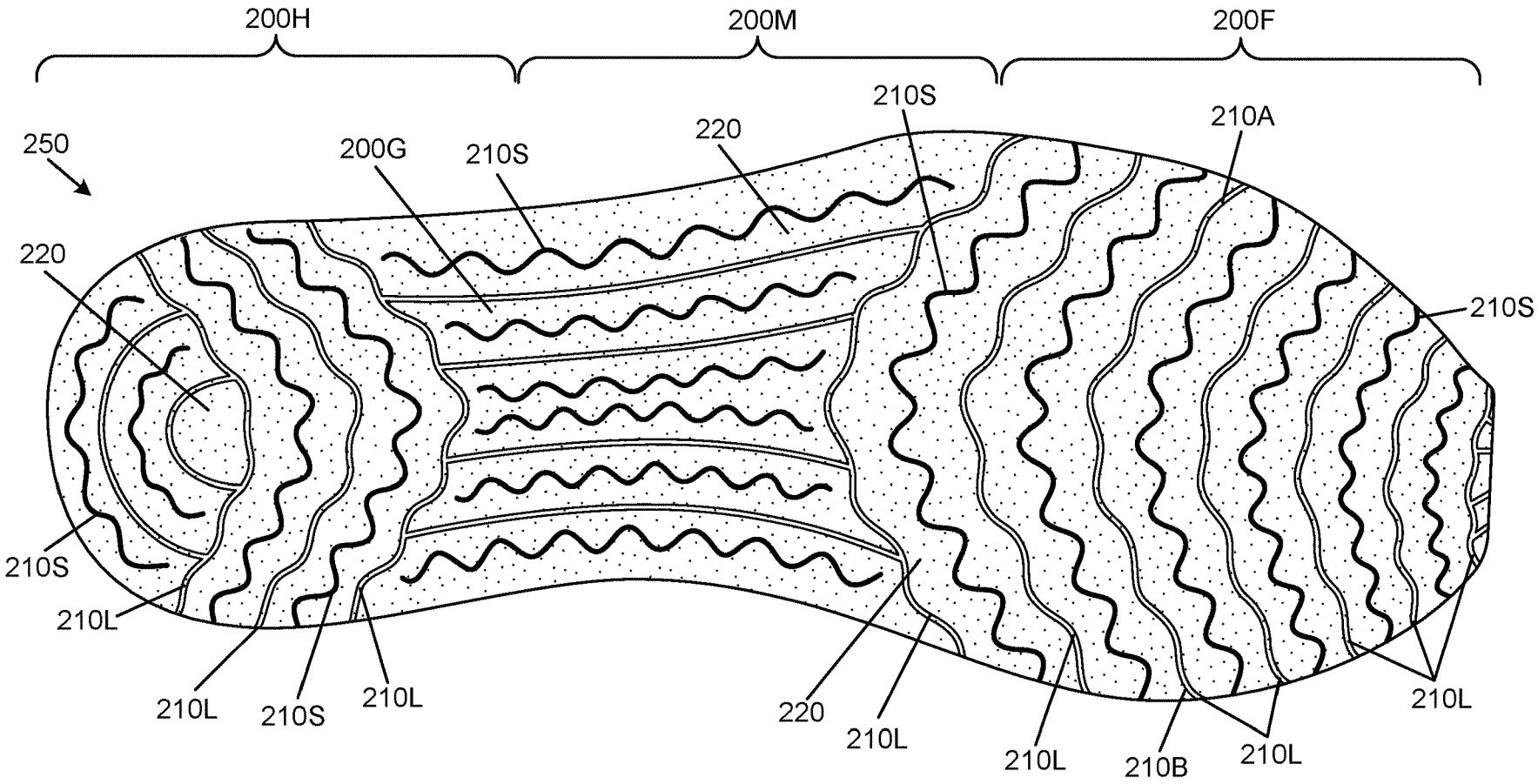
FIG. 3 provides a bottom view of another example sole structure in accordance with some examples of this technology.

FIG. 3 provides a bottom view of another example outsole component 250 in accordance with some aspects of this technology. Where the same reference numbers are used in FIG. 3 as used in FIGS. 1A-2B, the same or similar parts are being referenced and much of the corresponding overlapping description may be omitted. These parts in FIG. 3 identified by the same reference numbers used in FIGS. 1A-2B may have any of the features, options, properties, and/or alternatives described above in conjunction with FIGS. 1A-2B. Thus, the discussion below will focus on differences between the outsole component 250 of FIG. 3 and those described above in conjunction with FIGS. 1A-2B.

Like the example of FIGS. 1A-1E, the ground-facing surface 200G of the outsole component 250 of FIG. 3 includes a first plurality of grooves (larger grooves 210L) and a second plurality of grooves (smaller grooves 210S). These grooves 210L, 210S may have any of the features, properties, alternatives, and/or options described above for the examples of FIGS. 1A-2B, including any of the depth, width, and/or length features, properties, alternatives, and/or options. The example outsole component 250 of FIG. 3 differs from the outsole component 200 illustrated in FIGS. 1A-1E in that the base surface 220 is somewhat smoother in the example of FIG. 3 as compared to the example of FIGS. 1A-1E. The example ground-facing surface 200G of FIGS. 1A-1E appears somewhat more textured while still remaining flat or smoothly curved. In addition, in the example of FIG. 3, at least some of the first plurality of grooves (larger grooves 210L) have a "curve-within-a-curve" structure, e.g., akin to a sine wave. The example outsole component 250 of FIG. 3 also differs from the outsole component 200 of FIGS. 1A-1E in that more of the first plurality of grooves (larger grooves 210L) and the second plurality of grooves (smaller grooves 210S) extend continuously for longer distances, e.g., from one side edge of the outsole component 250 to the opposite side edge of the outsole component 250 in the forefoot support area 200F and/or in the heel support area 200H. The outsole component 250 of FIG. 3 also has fewer front-to-back extending grooves 210L and/or 210S.

Returning to FIGS. 1A-1E, additional features of sole structures 104 (including the outsole components 200, 250 of FIGS. 1A-3) now will be described. As shown in FIGS. 1A and 1D, the outsole component 200 of this illustrated example extends continuously in the midfoot area to form an upwardly extending lateral sidewall 230L of the outsole component 200. As shown, the upper-facing surface 200U and the ground-facing surface 200G of outsole component 200 extend around the lateral side edge of the midsole component 104M and upward along the lateral sidewall 104LW of the midsole component 104M to form the lateral sidewall 230L of the outsole component 200. The lateral sidewall 104LW of the midsole component 104M may include a recess in which the lateral sidewall 230L of the outsole component 200 extends and/or fits. The lateral sidewall 230L of outsole component 200 forms a portion of an exposed exterior lateral side surface of the article of footwear 100 in the midfoot area in this illustrated example. The article of footwear, sole structure, and outsole component 250 of FIG. 3 also may include similar lateral sidewall features.

Additionally or alternatively, as illustrated in FIGS. 1B and 1C, the outsole component 200 of this illustrated example extends continuously in the midfoot area to form an upwardly extending medial sidewall 230M of the outsole component 200. As shown, the upper-facing surface 200U and the ground-facing surface 200G of outsole component 200 extend around the medial side edge of the midsole component 104M and upward along the medial sidewall 104MW of the midsole component 104M to form the medial sidewall 230M of the outsole component 200. The medial sidewall 104MW of the midsole component 104M may include a recess in which the medial sidewall 230M of the outsole component 200 extends and/or fits. The medial sidewall 230M of outsole component 200 forms a portion of an exposed exterior medial side surface of the article of footwear 100 in the midfoot area in this illustrated example. The article of footwear, sole structure, and outsole component 250 of FIG. 3 also may include similar medial sidewall features (including any of the features described below).

At least some portion of the medial sidewall 230M formed by outsole component 200 in this illustrated example is located between parallel planes oriented at P=0.33 L and P=0.66 L with respect to the longitudinal length L of the sole structure 104 and/or article of footwear 100. As shown in FIG. 1B, the medial sidewall 230M of the outsole component 200 generally is located between parallel planes arranged at P=0.21 L and P=0.63 L (e.g., as shown, the medial sidewall 230M curves continuously between these parallel plane locations to create a concave sidewall surface). Thus, the rearward portion of the medial sidewall 230M in this example extends into the heel support area. Also, in this illustrated example, the medial sidewall 230M of the outsole component 200 forms a curved perimeter edge 230P. This curved perimeter edge 230P forms a peak or high point about at a parallel plane oriented at P=0.4 L (but this peak may be within a range of P=0.3 L and P=0.5 L). Further, as shown in FIGS. 1B and 1C, the medial sidewall 230M of this example includes a concave exterior surface at the midfoot support area (and extending into the heel support area) of the outsole component 200 (e.g., a smoothly curved exterior (and exposed) surface curving inward toward a centerline of the article of footwear 100). In at least some examples of this technology, the exposed medial sidewall 230M includes an exposed side surface having a surface area of at least 10 $cm^2$ in a midfoot support area and/or heel support area of the outsole component 200 (and in some examples, this exposed side surface area may be at least 15 $cm^2$ or even at least 20 $cm^2$). The curved and concave exterior surface of the exposed medial sidewall 230M may be sized and shaped to receive and contact the surface of a rope, e.g., during a rope climb event as described below. The midsole component 104M extends upward beyond the perimeter edge 230P of the outsole component 200 at the medial sidewall 230M and lateral sidewall 230L areas in this illustrated example (although this is not a requirement in all examples of this technology). All of the parallel plane locations identified above are with respect to the longitudinal length L of the overall sole structure 104, e.g., as shown in FIG. 1B.

As shown in FIGS. 1B and 1C, the medial sidewall 230M: (a) curves inwardly (e.g., continuously) in the horizontal direction in the midfoot area toward a centerline of the article of footwear 100 (e.g., in a generally parabolic shape), and (b) curves upwardly and outwardly from its bottom perimeter edge to form the concave structure. In this manner, the medial sidewall 230M may have a shape akin to a portion of a paraboloid, a quarter-dome or a quarter-sphere (or less than a quarter-dome or quarter-sphere shape). In the illustrated example, the medial sidewall 230M curves continuously in these directions between the parallel planes arranged at: (i) P=0.21 L (e.g., with the rear endpoint of the curve defining the concave medial sidewall 230M located at about P=0.21 L) and (ii) P=0.63 L (e.g., with the forward endpoint of the curve defining the concave medial sidewall 230M located at about P=0.63 L), although the endpoints of the curvature may be located at other positions (e.g., with a rear endpoint of the curve located within the range of P=0.15 L to 0.35 L (or even P=0.18 L to 0.33 L) and with a forward endpoint of the curve located within the range of P=0.45 L to 0.75 L (or even P=0.5 L to 0.7 L). The distance between the rear endpoint of the curve defining the concave medial sidewall 230M surface and the forward endpoint of the curve defining the concave medial sidewall 230M surface may be at least 0.25 L (and in some examples, at least 0.3 L, at least 0.35 L, between 0.25 L and 0.5 L, and/or between 0.3 L and 0.45 L).

Further, as shown in FIG. 1B, the medial sidewall 230M curves upwardly such that its perimeter edge 230P forms a peak (e.g., at about parallel plane P=0.41 L) located above the horizontal support surface S when the article of footwear 100 is oriented on a horizontal support surface S on its ground-facing surface in an unloaded condition. In at least some examples of this technology, the upward most extent of the medial sidewall (e.g., the highest location of perimeter edge 230P and/or the peak) may be located at least 0.5 inches above the horizontal support surface S, and in some examples, at least 0.75 inches or even at least 1 inch above the horizontal support surface S.

In at least some examples of this technology, at least some portion of the exposed medial sidewall 230M may be treated with a tackiness-enhancing material and/or formed from a tackiness-enhanced material (e.g., a relatively soft rubber or TPU material). Such material(s) may increase the coefficient of friction of the outsole component 200 with respect to a surface the medial sidewall 230M is expected to encounter during use. As noted above, some aspects of this technology may be included in for footwear used in obstacle course type events. Some obstacle courses have participants attempt to climb a rope suspended from an elevated point. Thus, at least the medial sidewall 230M (and potentially at least some portion of the ground-contacting surface 200G) of the outsole component 200 may be formed from a material (e.g., a rubber material that optionally may be selected or prepared to have enhanced tackiness) and/or treated (e.g., coated or sprayed with a material) to increase the coefficient of friction between the medial sidewall 230M and rope materials to be climbed. When used, the tackiness-enhanced materials and/or coatings may be selected to balance desired properties, e.g., to increase tackiness and/or the coefficient of friction with respect to a specific surface material (e.g., a rope) while not excessively reducing durability and/or while not being so tacky as to undesirably collect dust and/or other debris. Tackiness-enhanced materials and/or coatings for the medial sidewall 230M may be the same as or different from the tackiness-enhanced materials and/or coatings that may be provided on the ground-contacting surface 200G of the outsole component 200 described above. If useful, similar tackiness-enhanced materials and/or coatings may be used on or applied to the lateral sidewall 200LW as well.

Articles of footwear 100 in accordance with at least some examples of this technology may include additional features useful for rope climb or other obstacle course type events. As illustrated in FIGS. 1B and 1C, the instep region 102I of upper 102 of this example includes a medial eye stay reinforcement 120M. The medial eye stay reinforcement 120M may include one or more lace-engaging components (e.g., openings, loops, hardware components, etc.) located at a medial side of the instep region 102I. The lace-engaging component(s) may be provided along an inner edge of the medial eye stay reinforcement 120M, e.g., along an instep opening and/or adjacent a tongue element of the article of footwear 100.

The medial eye stay reinforcement 120M of this example defines a surface area of at least 6 $cm^2$ along the instep region 102I having a higher coefficient of friction than an upper material located immediately adjacent the medial eye stay reinforcement 120M (e.g., upper component 102A and/or 102MF). The area of higher coefficient of friction on the medial eye stay reinforcement may be at least 8 $cm^2$, at least 10 $cm^2$, or even at least 12 $cm^2$. The medial eye stay reinforcement 120M may have a higher coefficient of friction than one or more of the immediately adjacent upper materials with respect to a surface with which the eye stay reinforcement 120M may come into contact (e.g., a rope). The coefficient of friction may be increased in the medial eye stay reinforcement 120M by treating a surface of the eye stay reinforcement 120M with a tackiness-enhancing material (e.g., coating or spraying with a thermoplastic polyurethane material, a rubber material, etc.) and/or by forming the eye stay reinforcement 120M from a tackiness-enhanced material (e.g., a thermoplastic polyurethane and/or rubber material). When used, the tackiness-enhanced materials and/or coatings on the medial eye stay reinforcement 120M may be selected to balance desired properties, e.g., to increase tackiness and/or the coefficient of friction with respect to a specific surface material while not excessively reducing durability and/or while not being so tacky as to undesirably collect dust and/or other debris. Tackiness-enhanced materials and/or coatings for the medial eye stay reinforcement 120M may be the same as or different from the tackiness-enhanced materials and/or coatings that may be used for the ground-contacting surface 200G of the outsole component 200 and/or those used for the medial sidewall 230M described above.

As noted above, the material of the medial eye stay reinforcement 120M may have a higher coefficient of friction than one or more of the immediately adjacent upper materials with respect to a surface with which the eye stay reinforcement 120M may come into contact (e.g., a rope). As some more specific examples, the medial eye stay reinforcement 120M's coefficient of friction may be at least 10% higher (and in some examples, at least 15% higher, at least 20% higher, or even at least 25% higher) than a coefficient of friction of one or more of the immediately adjacent upper materials with respect to a specific surface (e.g., a surface with which the medial eye stay reinforcement 120M may come into contact during use, such as a rope material surface). Alternatively, rather than an eye stay reinforcement, the higher coefficient of friction material at the instep area of the medial side of the upper (e.g., in the upper midfoot area) may be formed from an upper component part (e.g., a medial instep upper component part) that does not engage a footwear lace and/or an upper component part (e.g., a medial instep upper component part) that does not include an eye stay and/or lace engaging function.

Additionally or alternatively, the lateral side 102L of the upper 102 may include a lateral eye stay reinforcement 120L. The lateral eye stay reinforcement 120L may have any of the features, properties, alternatives, and/or options described above for medial eye stay reinforcement 120M, including a higher coefficient of friction than one or more upper materials located immediately adjacent the lateral eye stay reinforcement 120L (e.g., within the relative ranges described above for the medial eye stay reinforcement 120M).

In use, the medial eye stay reinforcement 120M (or other medial instep upper component part) present on one shoe of a pair cooperates with the medial sidewall 230M present on the other shoe of the pair to pinch and hold a rope during a rope climb process (e.g., as part of an obstacle course event). The rope may be received in the concave recess of the medial sidewall 230M and pinched between the medial sidewall 230M of one shoe and the medial eye stay reinforcement 120M (or other medial instep upper component part) on the other shoe. The concave shape of the medial sidewall 230M may provide increased surface area for contacting the rope (which typically will have a generally round cross-sectional shape). This rope pinching or holding action between the user's two feet can provide support to enable the user to move (climb) up the rope. Additionally or alternatively, the rope may be held between the concave surfaces of the medial sidewalls 230M of the two shoes of the pair (for at least some of the rope climb "steps"). Tackiness-enhanced materials and/or coatings at the exterior surface(s) of the medial sidewall(s) 230M and/or the medial eye stay reinforcement(s) 120M may further help "grip" the rope and assist in this climbing effort. Such structures may provide enhanced traction or grip for any type of activity that may require a user "gripping" something between his/her feet.

Alternatively, if desired, the medial sidewall 230M need not be a part of the outsole component 200. Rather, a medial sidewall 230M for the uses described above could constitute a separate part, e.g., engaged with a medial sidewall 102M of the upper 102 and/or with the sole structure 104 (e.g., with the medial sidewall 104MW of midsole component 104M).

Figure 4:
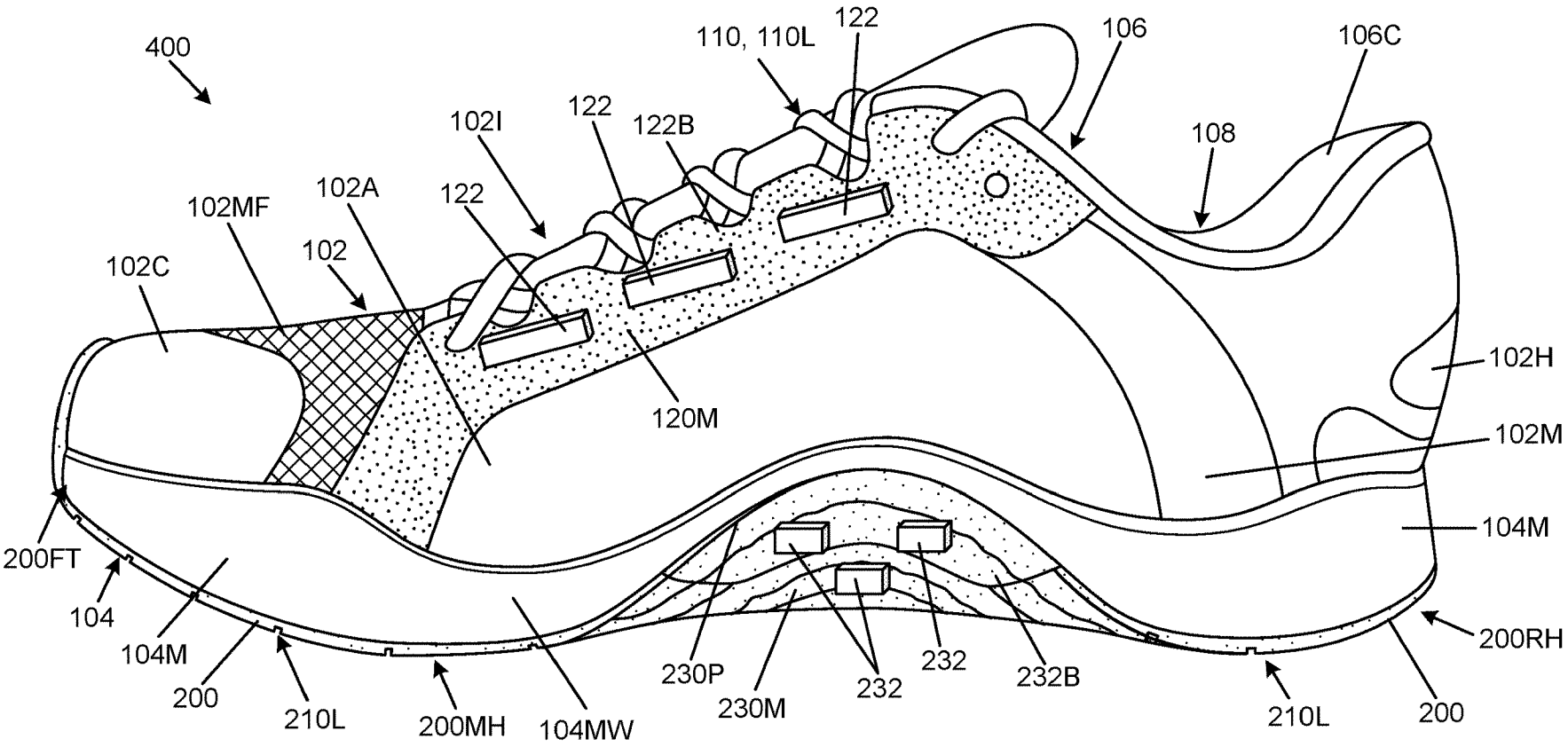
FIG. 4 illustrates another example article of footwear in accordance with some aspects of this technology.

Additionally or alternatively, traction at the medial midfoot area (e.g., medial sidewall 230M) and/or the eye stay reinforcement (e.g., medial eye stay reinforcement 120M) may be provided in other ways. FIG. 4 illustrates a medial side view of another example article of footwear 400 in accordance with some aspects of this technology. Where the same reference numbers are used in FIG. 4 as used in FIGS. 1A-3, the same or similar parts are being referenced and much of the corresponding overlapping description may be omitted. These parts in FIG. 4 identified by the same reference numbers used in FIGS. 1A-3 may have any of the features, options, properties, and/or alternatives described for the same parts above in conjunction with FIGS. 1A-3. Thus, the discussion below will focus on differences between the article of footwear 400 of FIG. 4 and those described above in conjunction with FIGS. 1A-3.

In the example of FIG. 4, the medial eye stay reinforcement 120M includes a base component 122B (e.g., formed of any desired upper material, including conventional upper materials) having one or more traction elements 122 formed integrally or engaged with it. The traction elements 122 may comprise raised ribs, raised nubs, grooves, recesses, patches of high coefficient of friction material, etc. Alternatively, rather than an eye stay reinforcement, one or more traction elements 122 at the medial instep area of the upper (e.g., in the upper midfoot area) may be formed from an upper component part (e.g., a medial instep upper component part) that does not engage a footwear lace and/or an upper component part (e.g., a medial instep upper component part) that does not include an eye stay and/or lace engaging function. Additionally or alternatively, the medial sidewall 230M (included as part of the outsole component 104 or as a separate part) includes a base surface 232B having one or more traction elements 232 formed integrally or engaged with it. The traction elements 232 may comprise raised ribs, raised nubs, grooves, recesses, patches of high coefficient of friction material, etc. The traction elements 122, 232 may be formed of high coefficient of friction material, e.g., with respect to a rope material or other material expected to contact traction elements 122, 232 in use. The traction elements 122, 232 also may have a higher coefficient of friction material with respect to a rope material or other material expected to contact traction elements 122, 232 than the upper material and/or sole material immediately around the traction elements 122, 232. The medial eye stay reinforcement 120M (or other medial instep upper component) with traction elements 122 may interact with the medial sidewall 230M (e.g., including traction elements 232) to engage a rope in the general manners described above. Additionally or alternatively, the medial sidewall 230M with traction elements 232 may interact with the medial eye stay reinforcement 120M or other medial instep upper component (e.g., including traction elements 122) to engage a rope in the general manners described above.

III. CONCLUSION

The present technology is disclosed above and in the accompanying drawings with reference to a variety of embodiments. The purpose served by the disclosure, however, is to provide an example of the various features and concepts related to the technology, not to limit its scope. One skilled in the relevant art will recognize that numerous variations and modifications may be made to the embodiments described above without departing from the scope of the present invention, as defined by the appended claims.

What is claimed is:

1. An article of footwear, comprising:

an upper including an instep region;

a medial eye stay reinforcement including lace-engaging components located at a medial side of the instep region, wherein the medial eye stay reinforcement defines a surface area of at least 6 $cm^2$ having a higher coefficient of friction than an upper material located immediately adjacent the medial eye stay reinforcement; and a sole structure engaged with the upper, the sole structure including an outsole component having an upper-facing surface and a ground-contacting surface located opposite the upper-facing surface, wherein material of the ground-contacting surface extends continuously from the ground-contacting surface, around a medial side edge of the sole structure, and forms an upwardly extending medial sidewall of the sole structure in a medial midfoot area of the article of footwear, wherein the ground-contacting surface includes:

(a) a first plurality of grooves extending from the ground-contacting surface toward the upper-facing surface, wherein at least 75% of a length of grooves of the first plurality of grooves have a first width dimension of at least 1 mm and less than 5 mm in a direction directly across the respective groove, wherein:

in a heel support area of the sole structure: (i) some of the first plurality of grooves are curved with apices of those curves located more rearward in the outsole component than ends of those curves, and (ii) some of the first plurality of grooves are curved with apices of those curves located more forward in the outsole component than ends of those curves, in a forefoot support area of the sole structure, at least some of the first plurality of grooves are curved with apices of those curves located more rearward in the outsole component than ends of those curves, and in a midfoot support area of the sole structure, at least some of the first plurality of grooves extend in a front-to-back direction of the sole structure;

(b) a second plurality of grooves extending from the ground-contacting surface toward the upper-facing surface, wherein at least 75% of a length of grooves of the second plurality of grooves have a second width dimension of less than 1 mm in a direction directly across the respective groove, wherein:

in the heel support area: (i) some of the second plurality of grooves are curved with apices of those curves located more rearward in the outsole component than ends of those curves, and (ii) some of the second plurality of grooves are curved with apices of those curves located more forward in the outsole component than ends of those curves, in the forefoot support area, at least some of the second plurality of grooves are curved with apices of those curves located more rearward in the outsole component than ends of those curves, and in the midfoot support area, at least some of the second plurality of grooves extend in the front-to-back direction; and (c) a base surface extending between the grooves of the first plurality of grooves and the second plurality of grooves, wherein the base surface includes flat or smoothly curved portions extending between the grooves of the first plurality of grooves and the second plurality of grooves, and wherein a combination of the first plurality of grooves, the second plurality of grooves, and the base surface forms at least 90% of the ground-contacting surface.

2. The article of footwear according to claim 1, wherein the upwardly extending medial sidewall includes a concave exterior surface formed of the material of the ground-contacting surface.

3. The article of footwear according to claim 1, wherein the upwardly extending medial sidewall includes a smoothly curved concave exterior surface formed of the material of the ground-contacting surface.

4. The article of footwear according to claim 1, wherein the upwardly extending medial sidewall includes a side surface having a surface area of at least 10 $cm^2$ formed from the material of the ground-contacting surface.

5. The article of footwear according to claim 1, wherein the sole structure further includes a midsole component underlying the outsole component, wherein the upwardly extending medial sidewall formed from the material of the ground-contacting surface covers a portion of a medial sidewall of the midsole component.

6. The article of footwear according to claim 1, wherein the first width dimension is less than 3 mm.

7. The article of footwear according to claim 1, wherein the outsole component includes a sole thickness dimension corresponding to a direct distance between the upper-facing surface and the ground-contacting surface, wherein at least 75% of the length of the grooves of the first plurality of grooves have a first depth dimension of at least 30% of the sole thickness dimension.

8. The article of footwear according to claim 7, wherein the first depth dimension is at least 50% of the sole thickness dimension.

9. The article of footwear according to claim 1, wherein the outsole component includes a sole thickness dimension corresponding to a direct distance between the upper-facing surface and the ground-contacting surface, wherein at least 75% of the length of the grooves of the second plurality of grooves have a second depth dimension of less than 30% of the sole thickness dimension.

10. The article of footwear according to claim 1, wherein the outsole component is formed from a rubber material.

11. The article of footwear according to claim 1, wherein the upper-facing surface and the ground-contacting surface extend continuously and form a support surface configured to support an entire plantar surface of a wearer's foot.

12. The article of footwear according to claim 1, wherein the forefoot support area of the sole structure curves upward in a direction from a metatarsal head support area to a forward toe area of the sole structure.

13. The article of footwear according to claim 1, wherein at least some of the second plurality of grooves are slits.

14. The article of footwear according to claim 1, wherein the ground-contacting surface consists only of the first plurality of grooves, the second plurality of grooves, and the flat or smoothly curved portions of the base surface.

15. The article of footwear according to claim 1, wherein the upper-facing surface and the ground-contacting surface extend continuously to form an upwardly extending lateral sidewall of the sole structure.

16. The article of footwear according to claim 1, wherein at least some of the second plurality of grooves have a curve-within-a-curve structure.

17. The article of footwear according to claim 16, wherein at least some of the first plurality of grooves have a curve-within-a-curve structure.

18. The article of footwear according to claim 1, wherein at least some of the second plurality of grooves have a sine wave structure.

19. The article of footwear according to claim 18, wherein at least some of the first plurality of grooves have a sine wave structure.

20. The article of footwear according to claim 1, wherein at least some of the first plurality of grooves have a sine wave structure or a curve-within-a-curve structure.

* * * * *